US009473868B2

(12) United States Patent
Huang et al.

(10) Patent No.: US 9,473,868 B2
(45) Date of Patent: Oct. 18, 2016

(54) MICROPHONE ADJUSTMENT BASED ON DISTANCE BETWEEN USER AND MICROPHONE

(71) Applicant: MStar Semiconductor, Inc., Hsinchu Hsien (TW)

(72) Inventors: Hung-Chi Huang, Taichung (TW); Cheng-Lun Hu, New Taipei (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 354 days.

(21) Appl. No.: 14/155,844

(22) Filed: Jan. 15, 2014

(65) Prior Publication Data

US 2014/0219472 A1 Aug. 7, 2014

(30) Foreign Application Priority Data

Feb. 7, 2013 (TW) ..... 102104833 A

(51) Int. Cl.

| | |
|---|---|
| ***H04R 3/00*** | (2006.01) |
| ***H04R 29/00*** | (2006.01) |
| ***H04R 1/40*** | (2006.01) |
| ***H04R 5/027*** | (2006.01) |

(52) U.S. Cl.

CPC ..... *H04R 29/005* (2013.01); *H04R 1/406* (2013.01); *H04R 5/027* (2013.01); *H04R 2201/403* (2013.01); *H04R 2499/11* (2013.01); *H04R 2499/15* (2013.01)

(58) Field of Classification Search

CPC .... H04R 29/005; H04R 3/005; H04R 1/406; H04R 5/027

USPC ..... 381/92

See application file for complete search history.

(56) References Cited

U.S. PATENT DOCUMENTS

| | | | | |
|---|---|---|---|---|
| 2005/0195989 | A1* | 9/2005 | Sato et al. | 381/92 |
| 2008/0262849 | A1* | 10/2008 | Buck et al. | 704/275 |
| 2010/0008519 | A1* | 1/2010 | Hayakawa et al. | 381/94.1 |
| 2010/0318353 | A1* | 12/2010 | Bizjak | 704/231 |

FOREIGN PATENT DOCUMENTS

| | | |
|---|---|---|
| TW | 581355 | 3/2004 |
| TW | 201101852 A1 | 1/2011 |
| TW | 201246949 A1 | 11/2012 |

* cited by examiner

*Primary Examiner* — Paul S Kim
*Assistant Examiner* — Katherine Faley
(74) *Attorney, Agent, or Firm* — Edell, Shapiro & Finnan, LLC

(57) ABSTRACT

A sound collecting system includes a plurality of microphones, a distance estimation module and an adjustment module. The distance estimation module estimates a distance to a user to accordingly provide a user distance. The adjustment module adjusts a part or all of the positions of the microphones according to the user distance.

11 Claims, 3 Drawing Sheets

MICROPHONE ADJUSTMENT BASED ON DISTANCE BETWEEN USER AND MICROPHONE

This application claims the benefit of Taiwan application Serial No. 102104833, filed Feb. 7, 2013, the subject matter of which is incorporated herein by reference.

BACKGROUND OF THE INVENTION

1. Field of the Invention

The invention relates in general to a sound collecting system and an associated method, and more particularly, to a sound collecting system capable of optimizing beamforming sound collecting effects through adjusting positions of microphones according to a user distance, and an associated method.

2. Description of the Related Art

Our daily life is filled with sounds. People also often express emotions and communicate with sounds. Therefore, diversified sound-related application technologies and electronic devices have been developed. For example, modern information manufacturers are dedicated in researching and developing sound control technologies, allowing users to intuitively control and operate electronic devices (more particularly consumer electronic products such as televisions) through sounds. Further, various electronic devices, such as telephones, cell phones, phone conference devices, digital cameras, camcorders, webcams and intercoms, which assist users to communication through sounds and/or record sounds, are also an indispensable part of the contemporary information lifestyle.

In the various kinds of sound-related application technologies and electronic devices, sound collecting is one of the most critical foundations. Therefore, it is a research and development focus of modern information manufacturers to provide a solution for clearly receiving sounds of a user (and/or a specific direction/position) and eliminating ambient background noises as well as increasing a signal-to-noise ratio (SNR).

SUMMARY OF THE INVENTION

The beamforming technology by utilizing a microphone array is capable of enhancing sound collecting effects. A microphone array includes multiple microphones, each of which receives sounds and converts sound waves of the sounds into associated electronic signals as fundamental audio signals. A beamforming algorithm processes these fundamental audio sounds of the microphones in the time-domain and/or frequency-domain to provide an integrated, synthesized and advanced audio signal. With signal processing, the beamforming technology may emphasize a sound from a specific direction and/or a specific position and suppress sounds from other directions and/or other positions. In equivalence, a sound collecting field can be focused toward a specific direction and/or at a specific position. Further, the beamforming technology may also identify a direction and/or a position by utilizing the microphone array.

However, the positions of the microphones in the microphone array affect the beamforming effects. For example, assuming that the microphones in the microphone array are more dispersed in space, the corresponding sound collecting field is more suitable for focusing a sound source located at a farther distance. In contrast, assuming that the microphones in the microphone array are more densely arranged, the corresponding sound collecting field is more suitable for focusing a sound source located at a closer distance.

It is an objective of the present invention to provide a sound collecting system, which utilizes a microphone array for sound collecting and is capable of dynamically and adaptively optimizing sound collecting effects of the microphone array. To operate in collaboration with the microphone array, the sound collecting system of the present invention includes a distance estimation module and an adjustment module. The distance estimation module estimates a distance to a user to accordingly provide a user distance. The adjustment module, coupled to the distance estimation module, adjusts a position of at least one microphone in the microphone array according to the user distance.

In one embodiment, the positions of the microphones are associated with a distance between the microphones, and the adjustment module adjusts the distance between the microphones according to the user distance. For example, when the user distance falls within a predetermined range, the adjustment module may separate two microphones farther away from each other as the user distance increases, thus increasing the distance between the two microphones. Conversely, when the user distance decreases, the adjustment module may move the two microphones closer to each other, thus decreasing the distance between the two microphones.

In one embodiment, the adjustment module may provide a target distance according to the user distance, and compare whether the distance between the microphones satisfies the target distance (e.g., an error between the two or a relative error is smaller than a tolerance). If not, the adjustment module adjusts the positions of the microphones to render the distance between the microphones to satisfy the target distance. When providing the target distance, if the user distance falls within a predetermined range, the adjustment modules renders the target distance to be positively correlated with the user distance. For example, the adjustment module may correspond a longer user distance to a longer target distance, and correspond a shorter user distance to a shorter target distance.

In one embodiment, the sound collecting system of the present invention further includes a processing module. The processing module processes the fundamental audio signals of the microphones in the microphone array to accordingly provide an advanced audio signal. For example, the processing module may process the fundamental audio signals of the microphones according to a beamforming algorithm to provide the advanced audio signal.

In one embodiment, the sound collecting system of the present invention further includes an application module. The application module is coupled to the processing module, and operates according to the advanced audio signal. For example, the sound collecting system may realize a sound control device having a sound control interface, and the application module may be utilized to recognize a sound command in the advanced audio signal to accordingly control operations of the sound collecting system. Further/Alternatively, the sound collecting system may be an electronic device that assists a user to communicate through sounds, and the application may be a communication module for transmitting the advanced audio signal to a network via wired or wireless means. Further/Alternatively, the sound collecting system may be an electronic device for sound recording, and the application module may be a storage module for storing and encoding the advanced audio signal to a recording medium, e.g., a hard drive, an optic disk and/or a flash memory.

In one embodiment, the processing module further provides a sound source direction according to the fundamental audio signals of the microphones in the microphone array, and the distance estimation module estimates the user distance according to the sound source direction. For example, assuming the distance estimation module identifies multiple users, a user making sounds may be identified according to the sound source direction provided by the processing module, and the user distance may be provided according to the distance to the user making sounds. After adjusting the positions of the microphones according to the user distance, the sound collecting effects of the microphone array with respect to the user making sounds can be optimized.

It is another objective of the present invention to provide a method applied to a sound collecting system. The sound collecting system includes a plurality of microphones. The method of the present invention includes estimating a distance from a user to the sound collecting system to accordingly provide a user distance, and adjusting a position of at least one of the microphones in the microphone array according to the user distance.

In one embodiment, the positions of the microphones are associated with a distance. The method of the present invention further includes: providing a target distance according to the user distance; adjusting the positions of the microphones when the distance does not satisfy the target distance so that the distances is updated and satisfies the target distance; and leaving the positions of the microphones unadjusted when the distance satisfies the target distance. In one embodiment, when the user distance falls within a predetermined range, the target distance is rendered to be positively correlated with the user distance.

In one embodiment, the method of the present invention further includes providing a sound source direction according to the sounds received by the microphones, and estimating a distance to the user according to the sound source direction.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
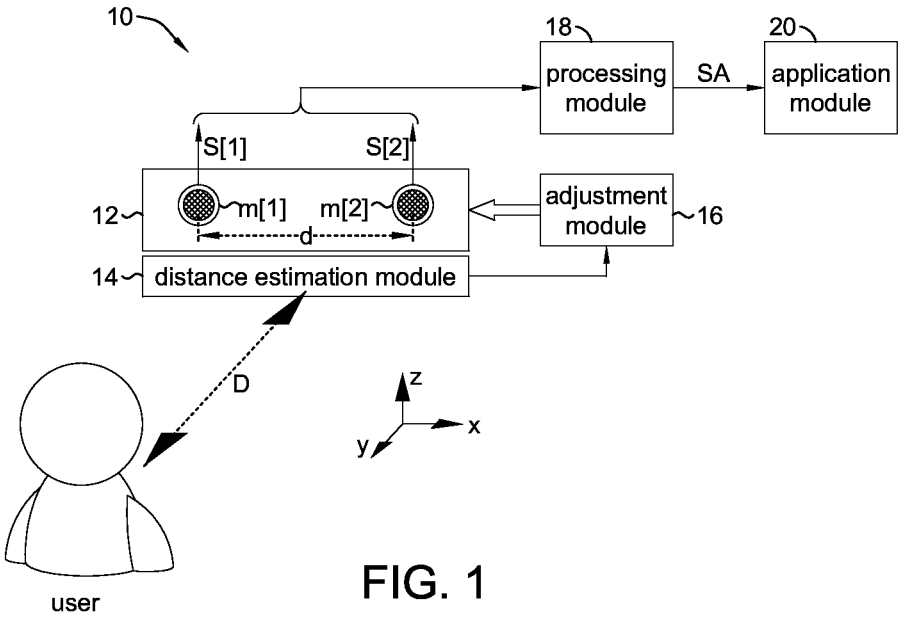
FIG. 1 is a schematic diagram of a sound collecting system according to an embodiment of the present invention.

FIG. 1 shows a schematic diagram of a sound collecting system 10 according to an embodiment of the present invention. Referring to FIG. 1, the sound collecting system 10 includes a microphone array 12, a distance estimation module 14, an adjustment module 16, a processing module 18 and an application module 20. The microphone array 12 includes a plurality of microphones, which are represented by microphones m[1] and m[2] in FIG. 1. The microphones m[1] and m[2] respectively receive sounds and convert the sounds into associated electronic audio signals S[1] and S[2] as fundamental audio signals. The distance estimation module 14 estimates a distance to a user to accordingly provide a user distance D. The adjustment module 16, coupled to the distance estimation module 14, adjusts positions of a part or all of the microphones in the microphone array 12 according to the user distance D.

Figure 2:
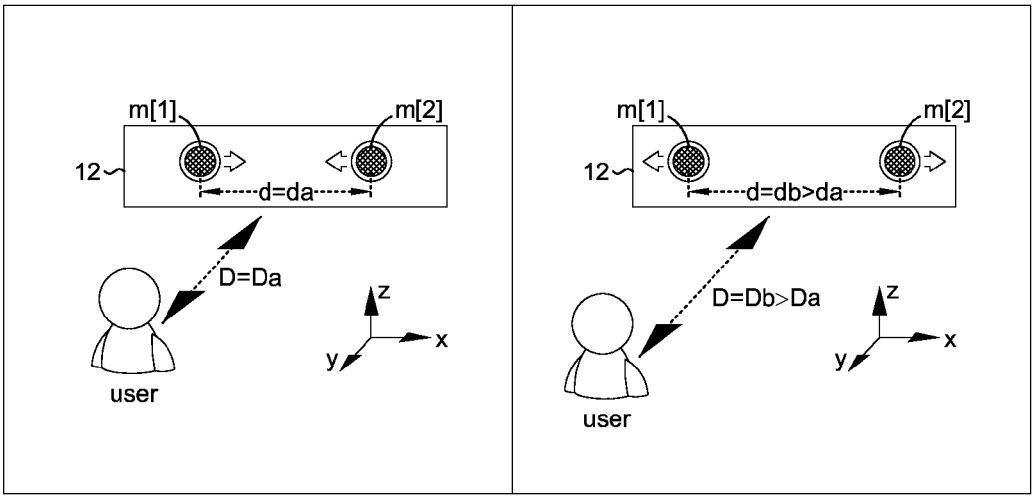
FIG. 2 is a schematic diagram of operations of a sound collecting system according to an embodiment of the present invention.

For example, in one embodiment, the microphones m[1] and m[2] may slide left and right along the x-direction, and are spaced from each other by a distance d. The distance d may be regarded as the size of an aperture of the microphone array. The user distance D may be a y-axis distance between the user and the microphone array 12. In one embodiment, the adjustment module 16 adjusts x-coordinates of the microphones m[1] and m[2] according to the user distance D, such that the distance d adaptively changes along with the user distance D. FIG. 2 shows a schematic diagram of adjusting positions of microphones along with a user distance according to an embodiment of the present invention. When the user distance D is a shorter distance Da, the adjustment module 16 renders the microphones m[1] and m[2] to be closer to each other along the x-axis, such that the distance d is equal to a shorter length da. As such, the microphone array 12 is capable of providing preferred sound collecting effects for a closer sound source, and/or identifying a direction and/or a position of a closer sound source with a preferred resolution. In contrast, when the user distance D is a longer distance Db, the adjustment module 16 renders the microphones m[1] and m[2] to be farther away from each other along the x-axis, such that the distance d correspondingly changes to a longer length db. As such, the microphone array 12 is capable of providing preferred sound collecting effects for a farther sound source, and/or more clearly identifying a direction and/or a position of a farther sound source. That is, the adjustment module 16 changes the distance d in a positively correlated manner along with the user distance D, i.e., the distance to the sound source, to optimize the sound collecting effects of the microphone array 12.

Again referring to FIG. 1, in the sound collecting system 10, the processing module 18, coupled to the microphone array 12, processes audio signals S[.] of the microphones m[.] in the microphone array 12 to accordingly provide an audio signal SA as an advanced audio signal. For example, the processing module 18 respectively performs different signal processes on the audio signals S[.] of different microphones m[.] according to a beamforming algorithm, and sums up the processed audio signals into the advanced audio signal. The signal processes performed on the audio signals S[.] of different microphones m[.] may include performing different timing delays or phase adjustments on the audio signals S[.], and/or scaling the audio signals S[.] of different microphones m[.] according to different weightings. With the signal processing, the processing module 18 may emphasize a sound from a specific direction and/or a specific position and suppress sounds from other directions and/or other positions. Further/Alternatively, the processing module 18 may also identify the direction and/or the position of the sound source.

As shown in FIG. 1, in the sound collecting system 10, the application module 20 is coupled to the processing module 18, and operates according to the audio signal SA. For example, the application module 20 may be integrated with a sound recognition function for recognizing a sound command (e.g., a voice command and/or a specific sound such as a clapping sound) in the audio signal SA to accordingly control operations of the sound collecting system 10, such that the sound collecting system 10 may realize a sound control device having a sound control interface, e.g., a sound control television. Further/Alternatively, the application module 20 may realize functions of a communication module, which converts, encodes, compresses, encrypts, packetizes and/or modulates the audio signal SA, and transmits the audio signal SA to a network via wired or wireless means, e.g., a mobile communication network or the Internet. Thus, the sound collecting system 10 is enabled to assist a user to communicate with sounds. Further/Alternatively, the application module 20 may be integrated with functions of a storage module, which converts, encodes, compresses and/or encrypts the audio signal SA and stores the processed audio signal SA to a storage medium, e.g., a hard drive, an optical disk and/or a flash memory, thereby allowing the sound collecting system 10 record sounds.

To achieve functions of the distance estimation module 14 for estimating the user distance D, the distance estimation module 14 may include two or more lenses (not shown). The lenses are located at different positions and are for capturing images of the user, so as to determine the user distance D according to parallax between the images captured by different lenses. When there are multiple users, the distance estimation module 14 may determine the user distance D according to the closest user or the farthest user, or calculate a statistical value (e.g., an average value) from different distances of the multiple users to accordingly determine the user distance D. In one embodiment, the distance estimation module 14 may be integrated with a human face recognition function for determining the position of the user to accordingly determine the user distance D.

In one embodiment, the distance estimation module 14 may be integrated with a feature comparison function for comparing whether a user feature matches the feature(s) of one or multiple predetermined host users, so as to determine the user distance according to only the user that matches the user feature but not according to the other users that do not match the user feature. For example, for a video conference system, the feature of a host (and/or a main speaker) may be set as a host feature, so that the microphone array 12 of the sound collecting system 10 follows the distance of the host (and/or the main speaker) to adaptively adjust the positions of the microphones.

In one embodiment, the distance estimation module 14 may be integrated with a motion detection function. When a motion of the user is detected, the user distance D may be determined according to the user in motion.

For distance estimation in other embodiments, the distance estimation module 14 may estimate the user distance D according to positioning techniques involving such as sonic waves, ultrasonic waves, shock waves, electromagnetic waves, laser and/or infrared.

In one embodiment, the processing module 18 further provides a sound source direction according to the audio signals S[.] of the microphones m[.] in the microphone array 12, and the distance estimation module 14 estimates the user distance D further according to the sound source direction. For example, assuming that the distance estimation module 14 is capable of recognizing multiple users, the distance estimation module 14 may further compare and determine the user making sounds according to the sound source direction provided by the processing module 18, and estimate the user distance D according to the distance to the user making sounds, thereby optimizing the sound collecting effects of the microphone array 12 for the user making sounds.

The adjustment module 16 may include a servo motor and/or a microelectromechanical systems (MEMS) component for moving a part or all of the microphones m[.]. Further/Alternatively, the processing module 18 may also adjust an operation parameter of the beamforming algorithm according to the user distance D provided by the distance estimation module 14 to change the distance for focusing and sound collecting of the sound collecting field. When adjusting the positions of the microphones according to the user distance D, the positions of certain microphones in the microphone array 12 may be kept fixed. For example, assume that the microphone array 12 includes three microphones m[1], m[2] and m[3] (not shown), the microphone m[3] is between the microphones m[1] and m[2], and the microphone m[3] is at a fixed position. When the user distance D gets farther, the adjustment module 16 moves the microphones m[1] and m[2] away from the microphone m[3] to optimize the sound collecting effects.

In one embodiment, the adjustment module 16 may determine which microphones are to be moved according to a value range of the user distance D, and determine distances for moving those microphones. For example, assume the microphone array 12 includes microphones m[1] to m[4]. When the value of the user distance D falls within a first range, the positions of the microphones m[1] to m[4] are changed along with the user distance D. When the value of the user distance D falls within a second range, only the positions of the microphones m[1] and m[4] are changed along with the user distance D, whereas the positions of the microphones m[2] and m[3] do not change along with the user distance D.

The microphones m[.] in the microphone array 12 may be arranged in a linear matrix, arranged in a two-dimensional array, or distributed on a two-dimensional plane, e.g., arranged along a circumference. For example, the microphones m[.] may be distributed along the x-axis and the z-axis. When the positions of the microphones are adjusted according to the user distance D, not only the x-coordinates of (a part or all of) the microphones m[.] but also the z-coordinates of (a part or all of) the microphones m[.] can be adjusted. For example, for a longer user distance D, the y-axis distance and the z-axis distance between the microphones m[.] may be increased accordingly.

Figure 3:
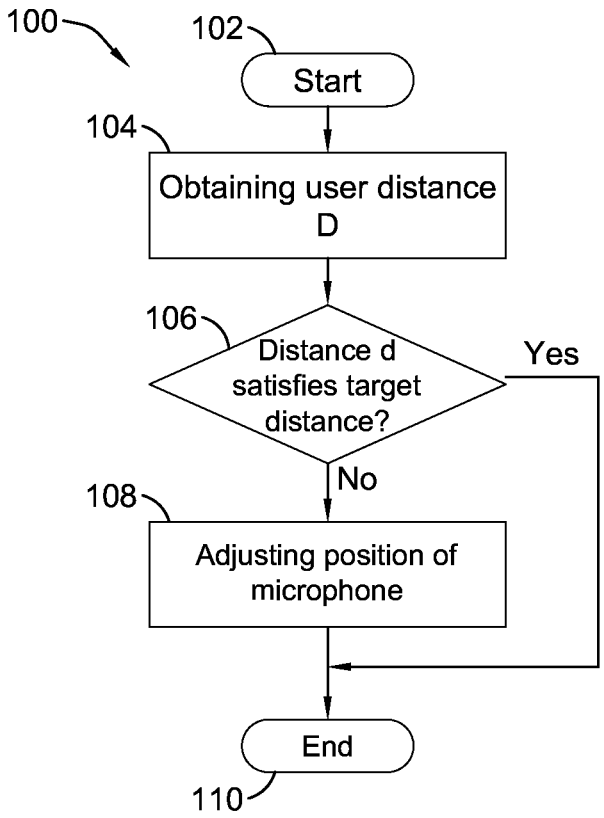
FIG. 3 is a flowchart of a process applicable to the sound collecting system in FIG. 1 according to an embodiment of the present invention.

FIG. 3 shows a flowchart of a process 100 according to an embodiment of the present invention. The process 100, applicable to the sound collecting system 10 in FIG. 1, includes the following steps.

In step 102, the process 100 begins. At this point, the distance d is equal to an initial value.

In step 104, the distance to the user is estimated by the distance estimation module 14, and the user distance D is accordingly provided.

In step 106, the adjustment module 16 calculates a target distance d_op according to the user distance D, and compares whether the distance d satisfies the target distance d_op (i.e., whether a difference or a relative difference between the distance d and the target distance d_op is smaller than a predetermined tolerance). Step 110 is performed if so, or else step 108 is performed if not. For example, when the user distance D falls within a predetermined range [D_min, D_max], the target distance d_op may be positively correlated with the user distance D. For example, the target distance d_op may be calculated as: $d_op=d_min+(d_max-d_min)*(D/D_max)$, where the values D_min, D_max, d_min and d_max are predetermined values. For example, the values d_min and d_max may be determined by a movable range of the microphones. Taking FIG. 1 for example, when the microphones m[1] and m[2] are moved to positions closest to each other, the distance d between the two may serve as a reference for setting the value d_min. Similarly, when the microphones m[1] and m[2] are moved to positions farthest from each other, the distance d may serve as a reference for setting the value d_max.

In step 108, the positions of the microphones are adjusted by the adjustment module 16, so that the distance d is updated to satisfy the target distance d_op.

In step 110, the process 100 ends.

It is seen from FIG. 3 that, if the initial value of the distance d at the beginning of the process 100 is equal to the target distance d_op in step 106, the process 100 directly proceeds to step 110 without adjusting the distance d. In one embodiment, the initial value of the distance d is equal to the value of the distance d before the process 100 begins.

Alternatively, the sound collecting system 10 may record a target distance d_op@pre obtained from a previous operation. When the process 100 is again performed, in step 102, the adjustment module 16 may render the initial value of the distance d to satisfy the target distance d_op@pre. For example, when the initial value of the distance d does not satisfy the target value d_op@pre, the positions of the microphones may be adjusted so that the distance d satisfies the target distance d_op@pre. After obtaining the current user distance D in step 104, in step 106, the distance d is compared to determine whether the distance d satisfies the new target distance d_op obtained from the current user distance D. Alternatively, the sound collecting system 10 may record the target distances d_op@pre obtained from multiple previous operations and calculate a representative value, which serves as the initial value of the distance d when the process 100 is again performed. For example, the representative value may be a value most frequently appearing in the multiple previous target distances d_op@pre, or a minimum value, a maximum value or an average value of the multiple previous target distances d_op@pre.

In one embodiment of the present invention, the audio processing module 18 may provide a sound source direction according to the sounds receives by the microphone array 12, and the distance estimation module 14 estimates the user distance D according to the sound source direction in step 104.

The sound collecting system 10 may periodically and regularly repeat the process 100, so that the positions of the microphones can be dynamically adjusted in real-time according to the change in the user distance D. Further/Alternatively, the sound collecting system 10 may also determine whether to initiate the process 100 according whether one or multiple trigger events occur individually or simultaneously. For example, a change in the sound source direction detected by the processing module 18 or an emerging sound detected by the processing module 18 may also be regarded as a trigger event. Further, the trigger event may include a volume change of a sound detected by the processing module 18, e.g., when the volume change exceeds a predetermined threshold. For another example, a trigger event may be a change in the user distance D detected by the distance estimation module 14. That is, when the processing module 18 detects a change in the sound source direction, and/or when the distance estimation module 14 detects a change in the user distance D, the sound collecting system 10 automatically starts the process 100 so that the microphones may be kept at optimum positions at all times.

In the sound collecting system 10 in FIG. 1, the various modules may be implemented by software, firmware and/or hardware. For example, the distance estimation module 14 may be implemented in collaboration by distance estimation hardware (e.g., a photographing lens) and distance solving software/firmware. The adjustment module 16 may be implemented by hardware such as a server mechanism and software/firmware that calculates positions (the target distance). The processing module 18 may be implemented by signal processing hardware (e.g., a processor), software (a code consisted of a beamforming algorithm), and/or firmware. The sound collecting system 10 may be a sound control electronic device, a device that assists a user to communication through sounds, and/or other kinds of electronic devices capable of recording sounds, e.g., sound control televisions, sound control household appliances, telephones, cell phones, phone conference devices, digital cameras, camcorders and/or webcams. The microphone array 12 and the modules of the sound collecting system 10 may be integrated into a same device, or disposed in different devices. For example, the microphone array 12, the adjustment module 16, the processing module 18 and the application module 20 may be disposed in the same device, and the distance estimation module 14 may be disposed in an appended peripheral device, with signals exchanged through wired or wireless means between the two devices.

In conclusion, the sound collecting technique of the present invention is capable of adaptively adjusting positions of microphones according to a distance between a user/sound source and a microphone array to optimize sound collecting effects of the microphone array, e.g., to improve an SNR of sound collecting, suppress background noises, and enhance a resolution and/or a recognition rate of a sound source direction.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A sound collecting system, comprising:

a plurality of microphones, configured to receive sounds;

a distance estimation module, configured to estimate a user distance between a user and the plurality of microphones; and an adjustment module, configured to adjust a position of at least one of the plurality of microphones according to the user distance, wherein the position of the at least one of the plurality of microphones is associated with a distance between the plurality of microphones, the adjustment module determines a target distance according to the user distance and compares whether the distance satisfies the target distance, and the adjustment module adjusts the position of the at least one microphone of the plurality of microphones when the distance does not satisfy the target distance so that the distance satisfies the target distance.

2. The sound collecting system according to claim 1, wherein when the user distance falls within a predetermined range, the adjustment module renders the target distance to be positively correlated with the user distance.

3. The sound collecting system according to claim 1, wherein the plurality of microphones provide an audio signal according to the received sounds, the sound collecting system further comprising:

a processing module, configured to process the audio signal to accordingly provide a processed audio signal.

4. The sound collecting system according to claim 3, wherein the processing module processes the audio signal according to a beamforming algorithm to provide the processed audio signal.

5. The sound collecting system according to claim 3, wherein the processing module further determines a sound source direction according to the audio signal, and the distance estimation module estimates the user distance to the user according to the sound source direction.

6. The sound collecting system according to claim 1, wherein the plurality of microphones are arranged in a linear array, arranged in a two-dimensional array, or distributed on a two-dimensional plane.

7. A method for a sound collecting system, the sound collecting system comprising a plurality of microphones, the method comprising:

estimating a user distance between a user and the plurality of microphones; and adjusting a position of at least one of the plurality of microphones according to the user distance, wherein the position of the at least one of the plurality of microphones is associated with a distance between the plurality microphones, the method further comprising:

determining a target distance according to the user distance; and comparing whether the distance satisfies the target distance, and adjusting the position of the at least one of the plurality of microphones when the distance does not satisfy the target distance to render the distance to satisfy the target distance.

8. The method according to claim 7, further comprising:

when the user distance falls within a predetermined range, rendering the target distance to be positively correlated with the user distance.

9. The method according to claim 7, wherein when the distance satisfies the target distance, the position of the at least one of the plurality of microphones is not adjusted.

10. The method according to claim 7, further comprising:

receiving sounds by the plurality of microphones to accordingly provide an audio signal; and processing the audio signal according to a beamforming algorithm to provide a processed audio signal.

11. The method according to claim 7, further comprising:

receiving sounds by the plurality of microphones to accordingly provide an audio signal;

determining a sound source direction according to the audio signal; and estimating the user distance to the user according to the sound source direction.

* * * * *